US008419210B2

(12) United States Patent
Mai

(10) Patent No.: US 8,419,210 B2
(45) Date of Patent: Apr. 16, 2013

(54) LAMP STRUCTURE FOR LIGHT STEEL FRAME

(76) Inventor: Mao-Kai Mai, Yangmei (TW)

( * ) Notice: Subject to any disclaimer, the term of this patent is extended or adjusted under 35 U.S.C. 154(b) by 239 days.

(21) Appl. No.: 13/069,494

(22) Filed: Mar. 23, 2011

(65) Prior Publication Data

US 2012/0020067 A1 Jan. 26, 2012

(30) Foreign Application Priority Data

Jul. 22, 2010 (TW) ..... 99214009 U

(51) Int. Cl.
*F21V 21/00* (2006.01)

(52) U.S. Cl.
USPC ..... 362/217.14; 362/217.16; 362/217.17

(58) Field of Classification Search ..... 362/217.14, 362/217.16, 217.17, 217.11
See application file for complete search history.

(56) References Cited

U.S. PATENT DOCUMENTS

| | | | | |
|---|---|---|---|---|
| 5,632,547 | A * | 5/1997 | Ge et al. | 362/16 |
| 5,636,919 | A * | 6/1997 | Walker | 362/396 |
| 7,798,685 | B2 * | 9/2010 | Edmond et al. | 362/473 |
| 2011/0141750 | A1 * | 6/2011 | Lin | 362/427 |

* cited by examiner

*Primary Examiner* — Evan Dzierzynski
(74) *Attorney, Agent, or Firm* — Jackson IPG PLLC

(57) ABSTRACT

A lamp structure for light steel frame comprises a lamp tube and two connectors respectively disposed at two ends of the lamp tube. The connectors have opening portions and snap-latch portions disposed to sides of the opening portions. The opening portions are fit to ends of the lamp tube. The snap-latch portions are used for clamping trusses of the light steel frame so that the lamp tube can be quickly and easily fastened to any position under the light steel frame without support of any tool. The structure adopts a single lamp tube to have light weight and modernity and improves the shortcoming of a light steel frame lamp in great volume.

7 Claims, 5 Drawing Sheets

LAMP STRUCTURE FOR LIGHT STEEL FRAME

BACKGROUND OF THE INVENTION

1. Field of the Invention

The present invention relates to a lamp structure for light steel frame, and more particularly to a lamp structure for light steel frame having installation convenience and applicability.

2. Description of the Related Art

Presently, illumination lamps applied to light steel frames of ceilings are adopted with fluorescent lamps. The specific structure can refer to Taiwan patent publication number M307089 "Lighting device assembled to ceiling suspension" and number 446091 "Ceiling lamp for ceiling suspension". Few lamps adopt sphere lamps shown in Taiwan patent publication number 456495 "Globular lampshade cell ceilings system". As shown in FIG. 1, a conventional ceiling type light steel frame lamp is that ceiling lamp housing is respectively disposed to a light steel frame of a ceiling in separate positions of fixed grids. The conventional ceiling type lamp housing 40 has an area as well as a grid of the light steel frame 30 and is installed onto the light steel frame 30 via a hidden manner to allow the lamp housing 40 to form a flat appearance together with the light steel frame 30. However, based upon the standard specification of the light steel frame, the size of the lamp must be designed to form a ceiling unit having 60×60 cm in either fluorescent lamps or sphere lamps. Consequently, it is difficult to satisfy the demand of different illumination brightness to flexibly regulate the number of light emitting elements, and it is difficult to match interior design as well.

Moreover, a general indoor illumination source mainly adopts a normal incidence type lamp. For example, a fluorescent lamp tube is installed to the ceiling. Light emitted by the fluorescent lamp tube is utilized to downwardly illuminate. Since modern technology is continuously developing, the technique of an illumination system is also rapidly evolving. The energy saving issue gradually becomes an important topic, and each government will prohibit incandescent lamp in the near future to cause a new illumination option, especially for LEDs. The LED having advantages of high efficiency, energy saving and dimming adjustable has been gradually applied to road lamps, vehicle lamps and outdoor illumination and scenario illumination in the illumination market.

SUMMARY OF THE INVENTION

In view of the shortcomings of the prior art, the inventor(s) of the present invention based on years of experience in the related industry to conduct extensive researches and experiments, and finally developed a lamp structure for light steel frame as a principle objective that allows users to repair and replace lamp tubes and that allows the users to flexibly select the installation number and position of lamps.

To achieve the foregoing objective, the lamp structure for light steel frame comprises a lamp tube and two connectors respectively disposed at two ends of the lamp tube. The connectors have opening portions and snap-latch portions disposed to sides of the opening portions. The opening portions are fit to ends of the lamp tube. The snap-latch portions are used for clamping trusses of the light steel frame so that the lamp tube can be quickly and easily fastened to any position under the light steel frame without support of any tool, and the installation numbers and position of lamp can be flexibly selected upon actual demands. The structure adopts single lamp tube to have light weight and modernity and greatly improves the shortcoming of a light steel frame lamp.

DETAILED DESCRIPTION OF THE PREFERRED EMBODIMENTS

The foregoing and other technical characteristics of the present invention will become apparent with the detailed description of the preferred embodiments and the illustration of the related drawings.

Figure 1:
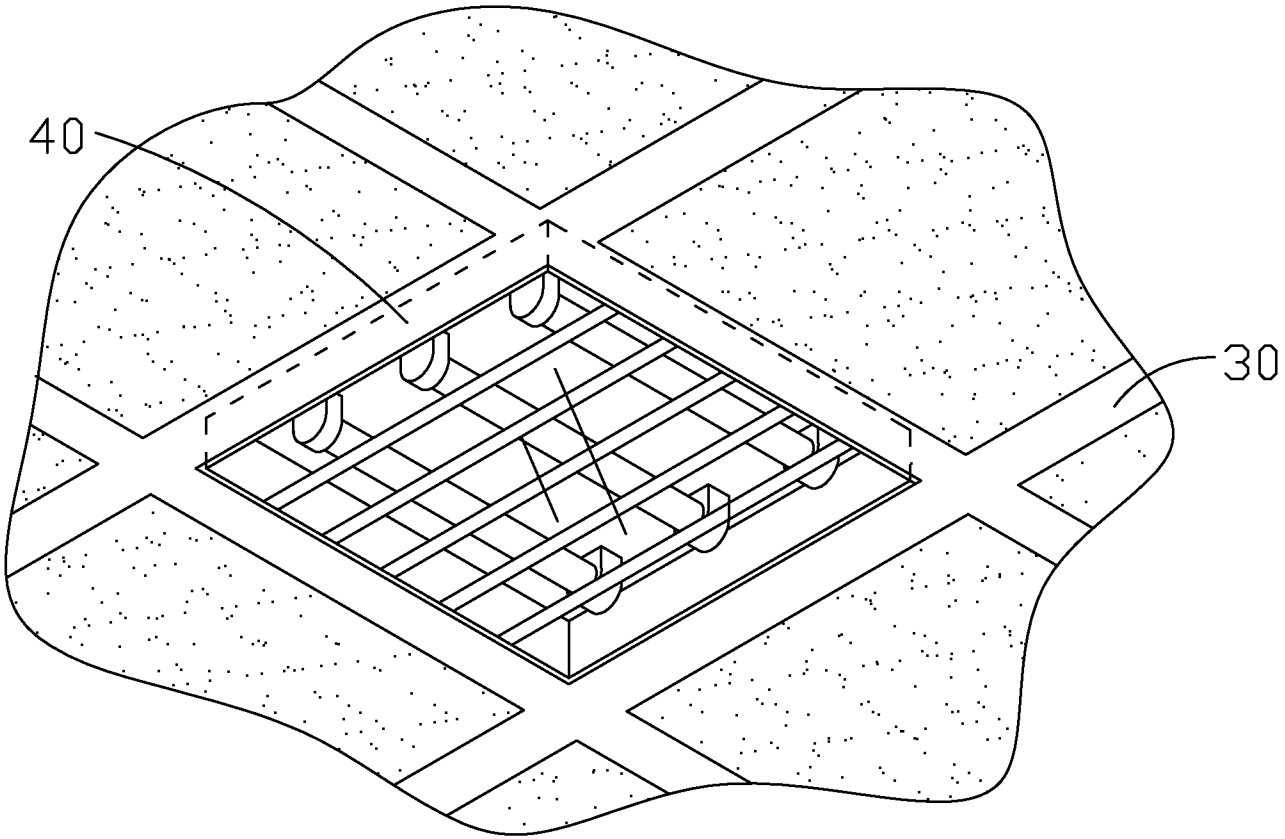
FIG.1 PRIOR ART
FIG. 1 is a three-dimensional diagram of actual installation of a conventional lamp housing type light steel frame lamp.
Figure 2:
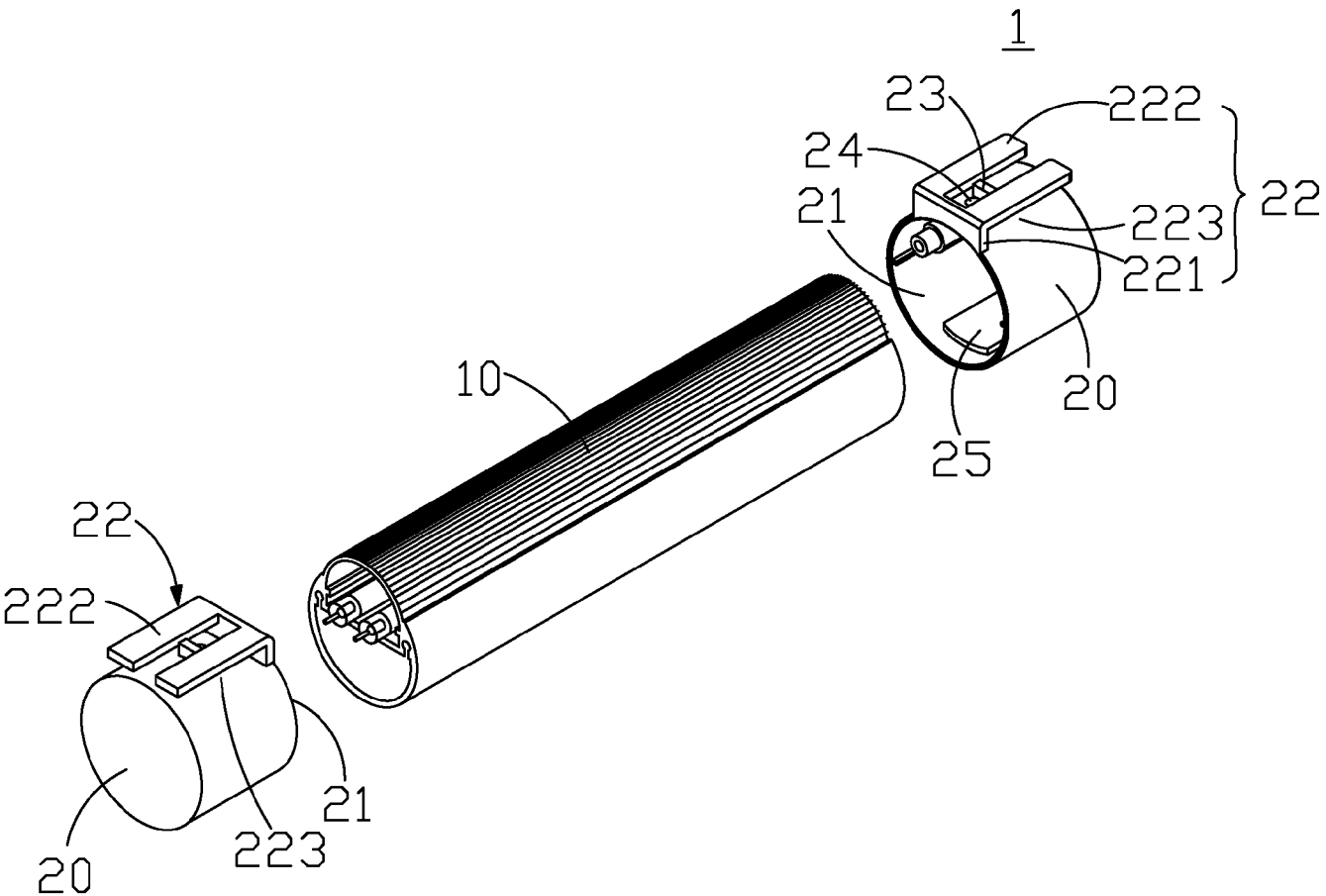
FIG. 2 is a decomposition drawing of a lamp structure according to the invention.
Figure 3:
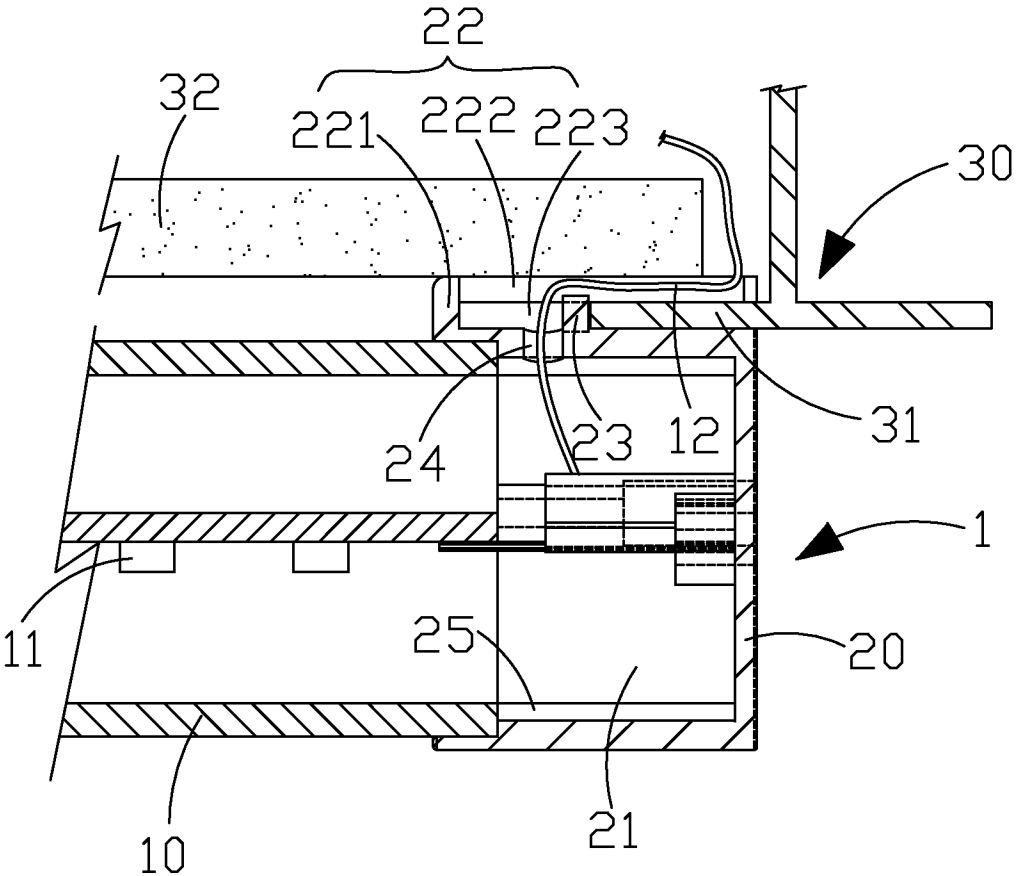
FIG. 3 is a cross-sectional drawing of an installation for a lamp structure installed to a light steel frame according to the invention.

With reference to FIG. 2 and FIG. 3 for schematic diagrams of a lamp structure for light steel frame in accordance with a present invention is depicted. The lamp structure 1 comprises a lamp tube 10 disposed with at least one light emitting element 11, wherein the light emitting element 11 can be a light emitting diode.

Two connectors 20 disposed at two ends of the lamp tube 10, the connectors 20 having opening portions 21 and snap-latch portions 22 disposed to sides of the opening portions 21, wherein the snap-latch portion 22 has a connection section 221 upwardly extended from a side of the opening portion 21, and at least one leaning section 222 is vertically extended from the connection portion 221 overlapped to the opening portion 21, and a containing interval 223 is formed between the leaning section 222 and the opening portion 21.

Figure 4:
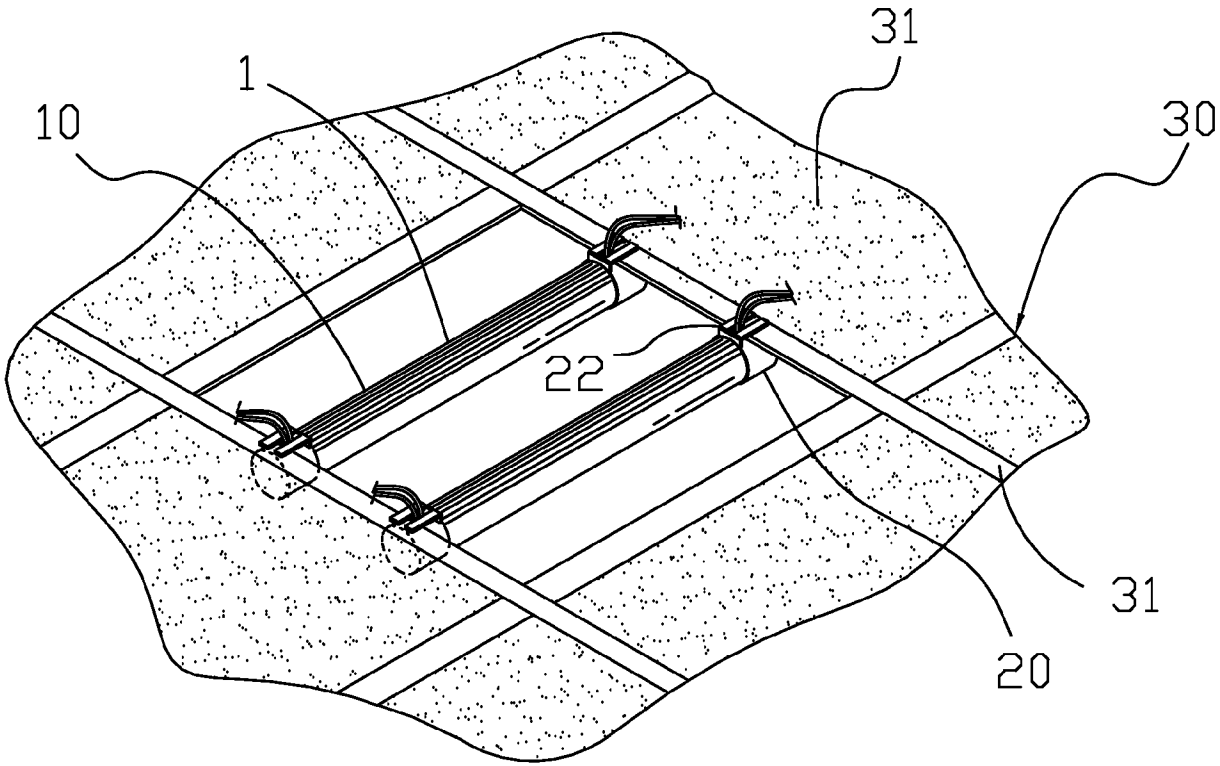
FIG. 4 is a three-dimensional drawing of an appearance of a lamp structure installed to a light steel frame according to the invention.
Figure 5:
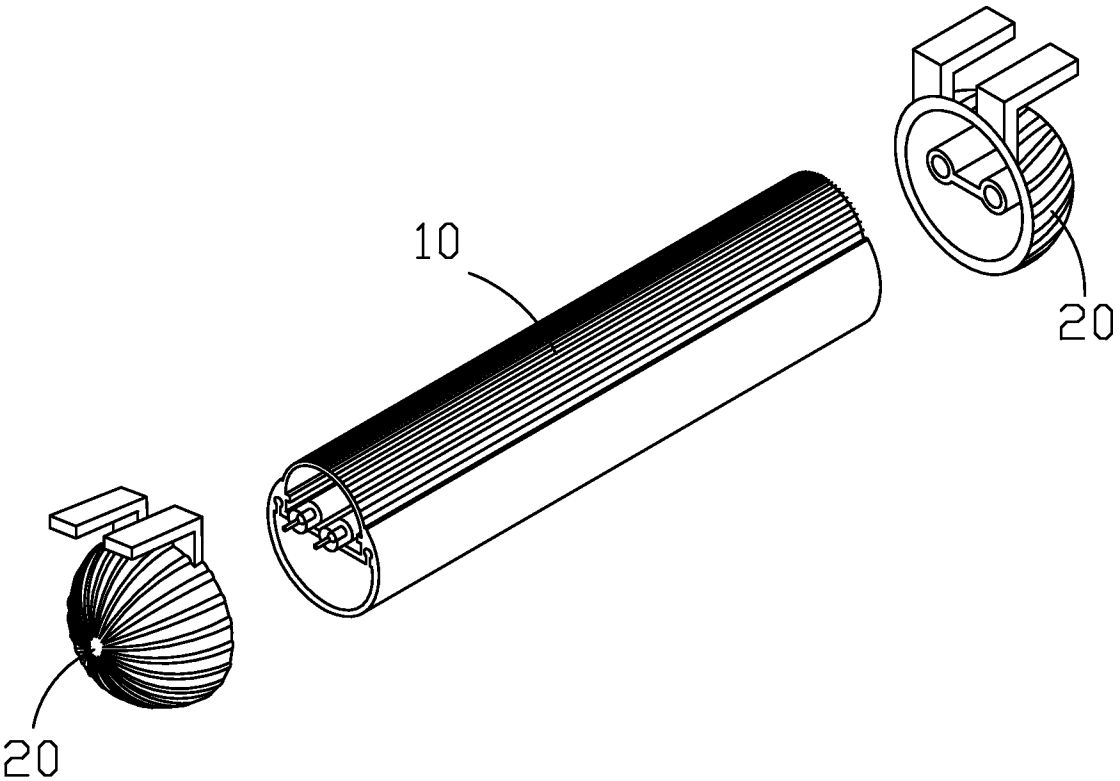
FIG. 5 is another decomposition drawing of a lamp structure according to the invention.

While in use, the opening portions 21 of the two connectors 21 are fit to ends of the lamp tube 10. The two snap-latch portions 22 are utilized to clamp two correspondingly trusses 31 of a light steel frame 30. As shown in FIG. 3 and FIG. 4, the containing interval 223 can contain the trusses 31 of the light steel frame to latch on the truss 31 through the leaning section 222 so that the lamp structure 1 can be fastened to the truss 31 of the light steel frame, and a ceiling 32 is crossed to the leaning section 222 to prevent edges of the ceiling 32 from being exposed, thereby maintaining the complete appearance of the ceiling. Of course, the shape of the connectors 20 can be shown in FIG. 2 or FIG. 5, and the connectors 20 can be formed with semicircles, wherein surfaces are disposed with several notches.

Moreover, the external circumferences of the connectors 20 have first baffle portions 23 near the snap-latch portions 22 as shown in FIG. 2 and FIG. 3, wherein opening holes 24 are further disposed between the first baffle portions 23 and the opening portions 21. Inner circumferences of the connectors 20 have at least one second baffle portion 25. The first baffle portion 23 is used for restricting position of the truss 31 stretching in the containing interval 223. Power line 12 for connecting each light emitting element 11 in the lamp tube 10 is connected to outside through the opening hole 24. The second baffle portion 25 is used for restricting the position of the lamp tube 10 stretched in the opening portion 21.

The preferable lamp structure for light steel frame improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

What is claimed is:

1. A lamp structure for light steel frame comprising:

a lamp tube having at least one light emitting element therein;

two connectors disposed to two ends of the lamp tube, the connectors having opening portions and snap-latch portions disposed to sides of the opening portions, the opening portions capable of being fit to the ends of the lamp tube, the snap-latch portions for clamping trusses of the light steel frame, wherein the snap-latch portion has a connection section upwardly extended from a side of the opening portion, and at least one leaning section is vertically extended from the connection portion overlapped to the opening portion, and a containing interval is formed between the leaning section and the opening portion, and the containing interval is used for containing trusses of the light steel frame.

2. The lamp structure for light steel frame as recited in claim 1, wherein external circumferences of the connectors have first baffle portions near the snap-latch portions.

3. The lamp structure for light steel frame as recited in claim 2, wherein opening holes are further disposed between the first baffle portions and the opening portions.

4. The lamp structure for light steel frame as recited in claim 1, wherein inner circumferences of the connectors have at least one second baffle portion.

5. The lamp structure for light steel frame as recited in claim 1, wherein the light emitting element is a light emitting diode.

6. The lamp structure for light steel frame as recited in claim 1, wherein the connectors are semicircles.

7. The lamp structure for light steel frame as recited in claim 6, wherein surfaces of the connectors are disposed with several notches.

* * * * *